US006918446B2

(12) United States Patent
Borak, Jr.

(10) Patent No.: US 6,918,446 B2
(45) Date of Patent: Jul. 19, 2005

(54) ONE-TRIP WELLHEAD INSTALLATION SYSTEMS AND METHODS

(75) Inventor: Eugene A. Borak, Jr., Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 99 days.

(21) Appl. No.: 10/681,703

(22) Filed: Oct. 8, 2003

(65) Prior Publication Data

US 2004/0069493 A1 Apr. 15, 2004

Related U.S. Application Data

(63) Continuation of application No. 10/152,878, filed on May 21, 2002, now abandoned.
(60) Provisional application No. 60/293,456, filed on May 24, 2001.

(51) Int. Cl.[7] ..... E21B 23/08
(52) U.S. Cl. ..... 166/382; 166/338; 166/95.1
(58) Field of Search ..... 166/338, 344, 166/342, 351, 368, 95.1, 382

(56) References Cited

U.S. PATENT DOCUMENTS

| | | | | |
|---|---|---|---|---|
| 3,741,294 A | * | 6/1973 | Morrill | 166/367 |
| 3,824,850 A | * | 7/1974 | Nutter | 73/152.23 |
| 3,974,875 A | * | 8/1976 | Herd et al. | 166/367 |
| 5,148,870 A | | 9/1992 | Fernandez et al. | |
| 5,255,746 A | | 10/1993 | Bridges | |
| 5,450,904 A | | 9/1995 | Galle | |
| 5,566,761 A | | 10/1996 | Pallini, Jr. et al. | |
| 5,607,019 A | | 3/1997 | Kent | |
| 5,638,903 A | | 6/1997 | Kent | |
| 5,653,289 A | | 8/1997 | Hosie et al. | |
| 6,401,827 B1 | * | 6/2002 | Ferguson et al. | 166/382 |

* cited by examiner

*Primary Examiner*—Frank Tsay
(74) *Attorney, Agent, or Firm*—Bracewell & Giuliani LLP

(57) ABSTRACT

Methods and devices are described for efficiently installing sea-borne wellhead components and tying back sub-sea wellhead components with them. In specific aspects, a single running and setting tool is used to land a tubing head housing upon the stem of a floating platform and tension and pressure testing casing string risers extending between a subsea wellhead and a floating vessel.

22 Claims, 13 Drawing Sheets

ONE-TRIP WELLHEAD INSTALLATION SYSTEMS AND METHODS

This application is a continuation of application Ser. No. 10/152,878, filed May 21, 2002 now abandoned, entitled—One-Trip Wellhead Installation Systems and Methods, which application claimed the priority of provisional patent application Ser. No. 60/293,456, filed May 24, 2001.

BACKGROUND OF THE INVENTION

1. Field of the Invention

The invention relates to methods and devices for assembly of portions of a sea-based, hydrocarbon production well. More specifically, the invention relates to methods and devices for efficiently installing sea-borne wellhead components and tying back sub-sea wellhead components with them. In specific aspects, the invention provides methods and devices for running and setting of a tubing head assembly upon the stem of a floating platform using a single trip by a single tool. In other aspects, the invention provides devices and methods for tensioning and pressure testing casing string risers using the same single tool.

2. Description of the Related Art

In sea-based wellhead systems, there is typically a sub-sea wellhead that is installed on the ocean floor and a surface wellhead that is located on a floating platform or rig above the sub-sea wellhead. The two wellheads are tied together with a riser system. Currently, it is necessary to employ different specialized tools to perform the various operations associated with landing and testing the tubing head portion of the surface wellhead upon the stem of the floating platform or rig as well as for testing the integrity of the riser or casing string. Unfortunately, this is a time-consuming and costly process since a number of separate tool runs must be made with the necessary specialized tools being installed and then removed. Time must be taken for each separate run of equipment as well as for refitting the running tool with new equipment. Prior art systems are capable of performing some of these tasks, but not all of them in an acceptable manner.

A solution to the problems of the prior art would be desirable.

SUMMARY OF THE INVENTION

A wellhead assembly system is described wherein a single running and setting tool is used to land the tubing head portion of a wellhead assembly on the stem of a floating platform. In operation, the running and setting tool supports the riser, tensions the riser string, sets the seal between the riser and the wellhead, and tests the packoff in a single trip. The running and setting tool also allows a means for a pressure test of the riser string and tieback connector prior to setting the wellhead. This provides a significant time-saving advantage over conventional systems wherein it is necessary to disassemble the tool following running and landing of the riser in order to run a special pack off setting and test tool. Blowout preventer nipple up operations may occur immediately thereafter.

In other aspects, the invention of the present system incorporates a load cell monitoring system within the tubing head assembly for use in precisely measuring tension load on the riser string. In a described embodiment, the load cell monitoring system is incorporated into a stem head to wellhead seal.

DETAILED DESCRIPTION OF THE PREFERRED EMBODIMENTS

Figure 1:
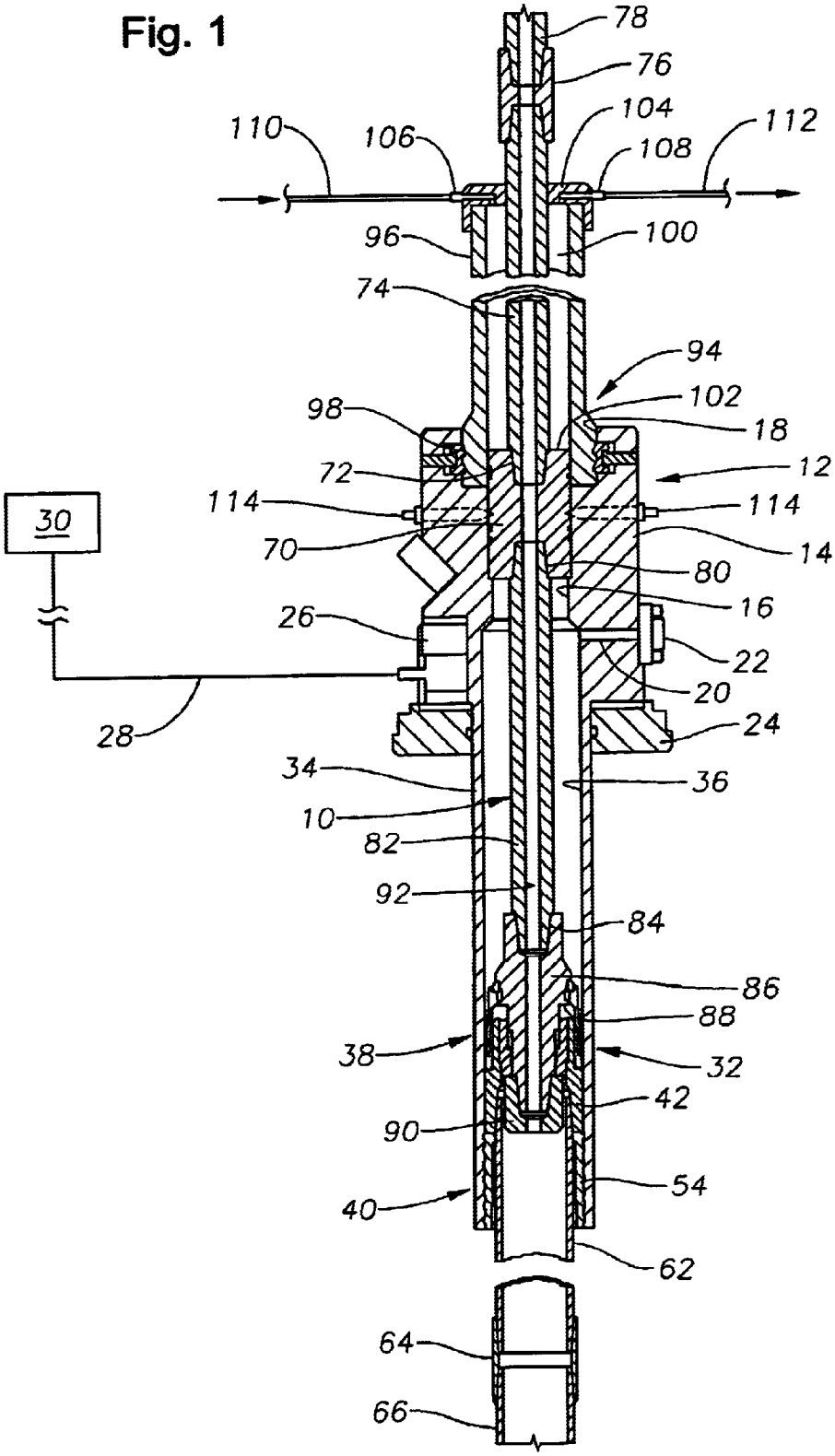
FIG. 1 is a side cross-sectional view of an exemplary wellhead running and setting tool constructed in accordance with the present invention affixed to a wellhead assembly and configured prior to landing of the wellhead assembly in the stem of a floating platform.

Referring first to FIG. 1, there is shown a first exemplary embodiment for a running and setting tool, generally shown as 10, that is disposed within and associated with the tubing head assembly 12 for a wellhead to be constructed on a floating platform (not shown).

The tubing head assembly 12 is made up of a generally cylindrical housing 14 that defines a central bore 16 therethrough with an NT-2 landing profile 18 at its upper end. A lateral fluid test port 20 is disposed through the side of the housing 14 and is initially closed off by a removable cover 22.

The central portion of the housing 14 is seated upon a stem head adapter plate 24 that is shaped and sized to engage the stem of a floating platform in a complimentary manner. Three load cells 26 (one shown) are retained within the housing 14 and support the upper end of the housing 14 so as to measure the load placed upon the housing 14 by the weight of casing lengths being suspended from the housing 14. The load cells 26 typically comprise an electronic measuring device useful for measuring weight loads. As FIG. 1 illustrates, a cable 28 interconnects the load cells 26 with a device 30, such as a computer, that is useful for recording, interpreting, reporting and/or storing the weight readings.

A lower wellhead assembly 32 extends downwardly from the housing 14. The lower wellhead assembly 32 includes a casing sleeve 34 that encloses an enlarged tubular bore 36 that is shaped and sized to admit the passage of wellbore casing therethrough. In addition, the lower wellhead assembly 32 includes a riser seal assembly 38 and a ratchet suspension assembly 40 that retains a casing string within the sleeve 34.

Figure 1A:
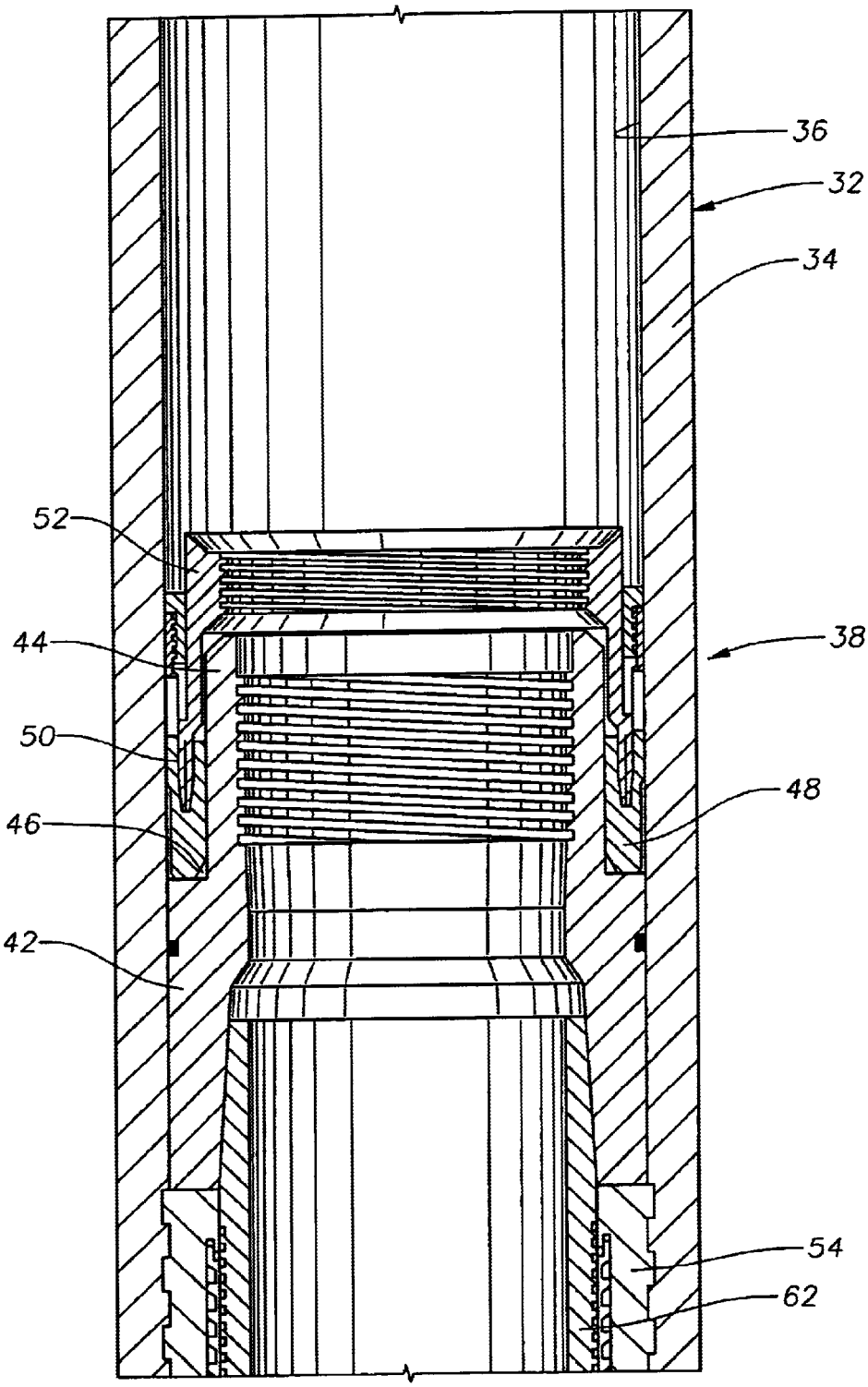
FIG. 1A is a closeup view of components of a seal assembly within the wellhead assembly shown in FIG. 1 shown without the running and setting tool.
Figure 1B:
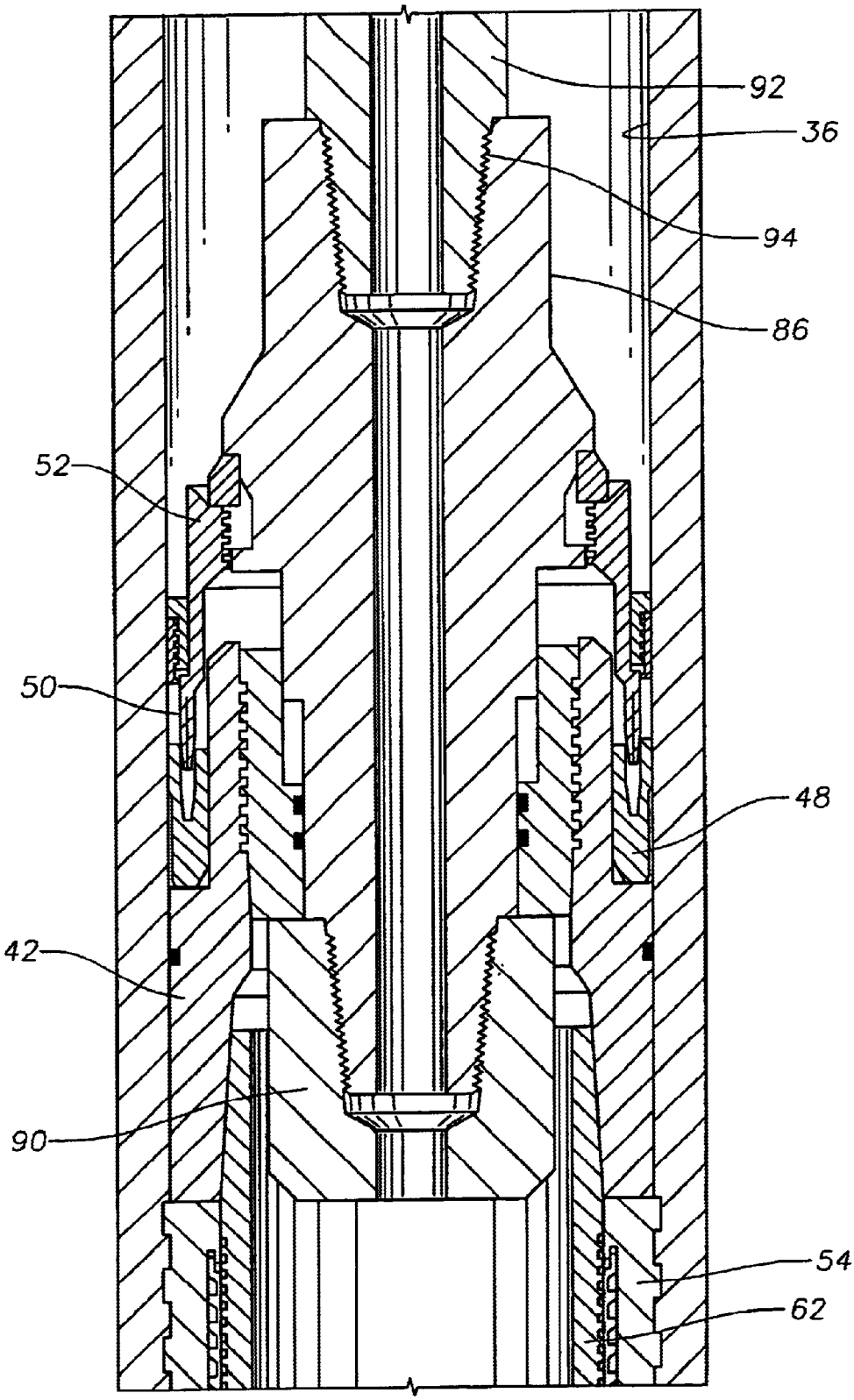
FIG. 1B is a closeup view of the seal assembly components with a running and setting tool engaged.
Figure 1C:
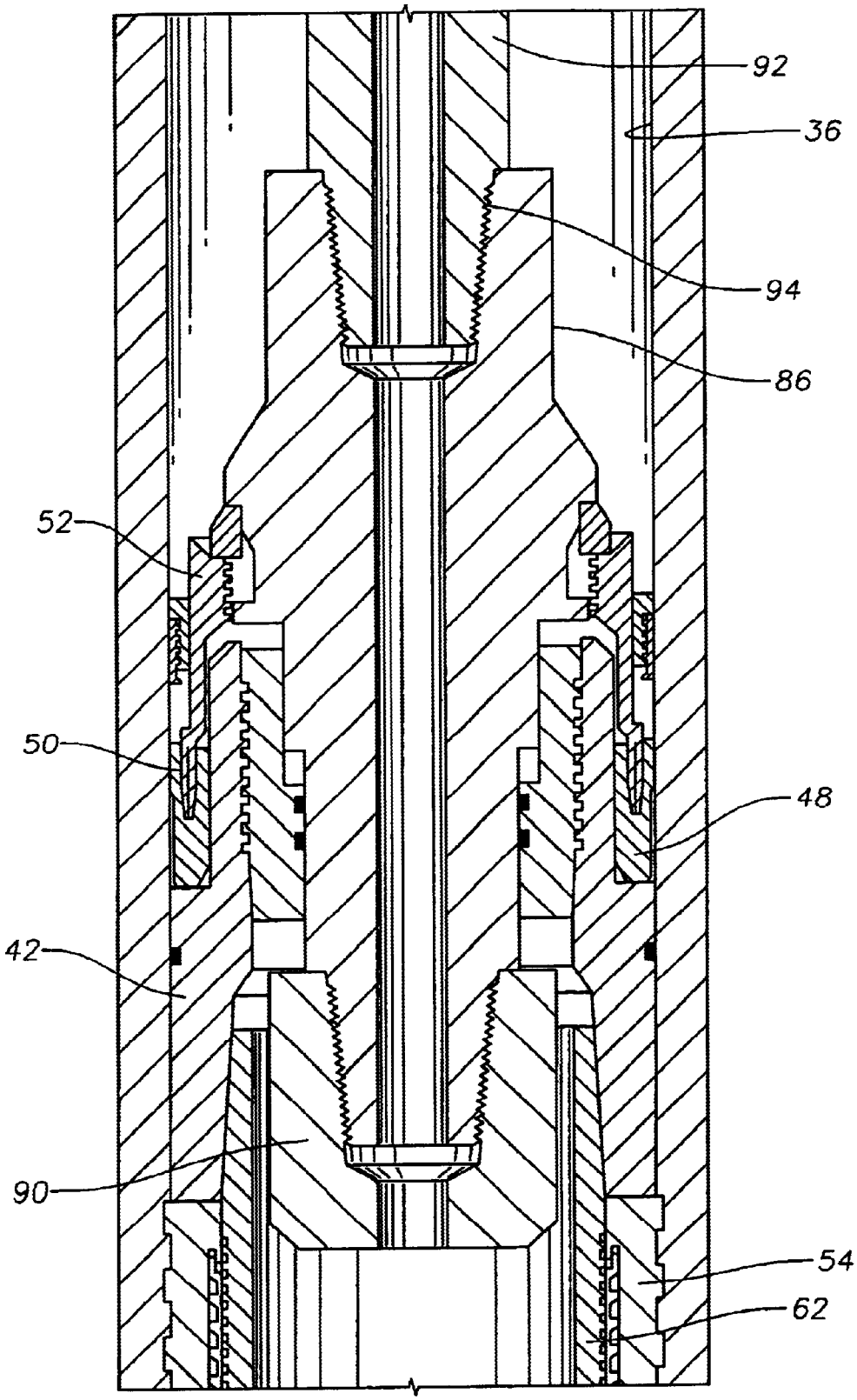
FIG. 1C is a closeup view of the seal assembly and running/setting tool, as shown in FIG. 1B wherein the seal components now having been set.
Figure 1D:
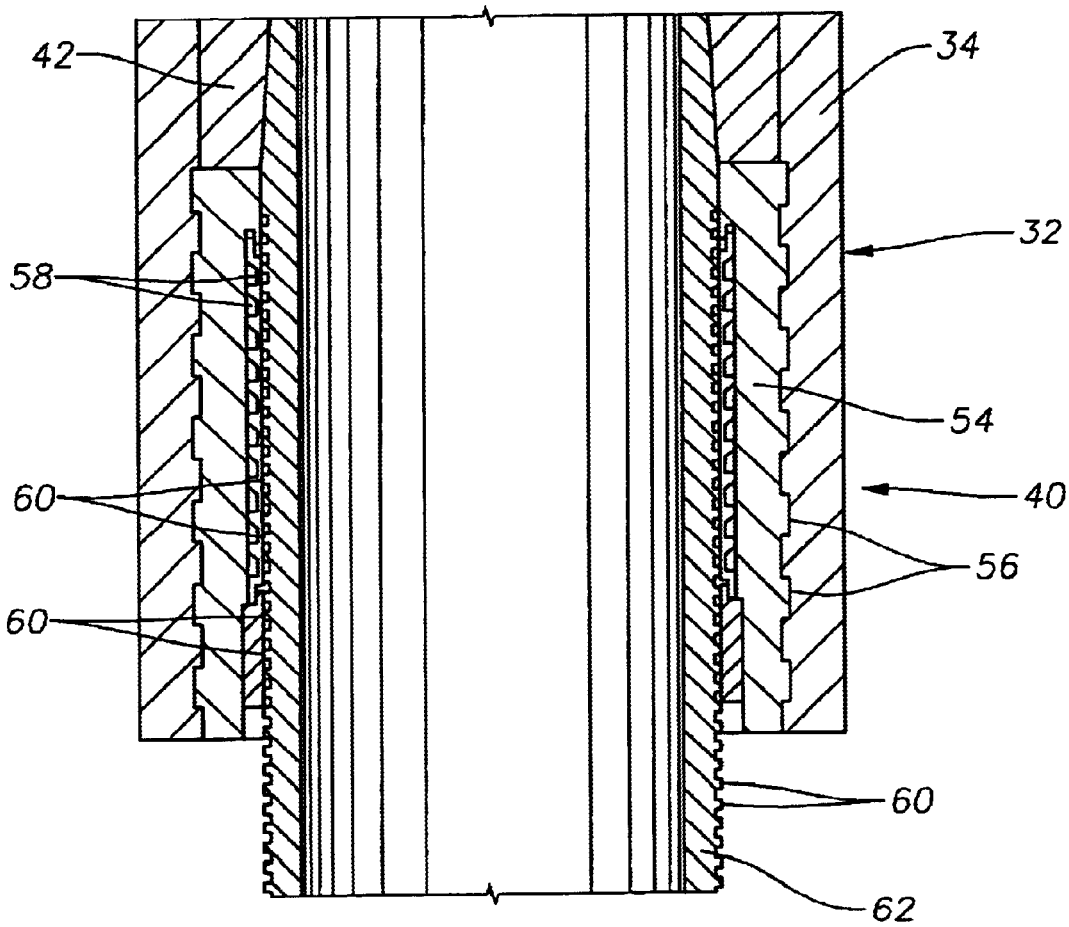
FIG. 1D is a closeup view of a ratchet suspension used within the wellhead assembly.

FIGS. 1A, 1B and 1C further illustrate the details concerning the seal assembly 38 in greater detail while FIG. 1D illustrates the details relating to the ratchet suspension assembly 40 in greater detail. FIG. 1A depicts the seal assembly 38 apart from portions of the running and setting tool and in a configuration wherein the seal has been energized. FIGS. 1B and 1C show in greater detail the setting of the annular seal 48 using the running and setting tool.

The seal assembly 38 is known commercially as an MSCB seal. Since the construction and operation of this type of seal assembly is understood by those in the art, those details will be discussed only briefly herein. The seal assembly 38 is used to establish a fluid-tight seal above the hanger body 42 within the sleeve 34. The upper end 44 of the hanger body 42 has a reduced external diameter thereby creating a seal pocket 46 between the hanger body 42 and the sleeve 34. Annular seal member 48 has a U-shaped profile and is disposed within the pocket 46. A wedge 50 is located within the annular seal member and, when moved downwardly into the seal 48, the wedge 50 will set or energize the seal by urging its sides outwardly against the sleeve 34 and the hanger body 42. A setting sleeve 52 is disposed above the seal 48 abutting wedge 50. When the setting sleeve 52 is urged downwardly, the wedge 50 energizes the seal 48.

As is best shown in FIG. 1D, the ratchet suspension assembly 40 includes a ratchet member 54 that is secured by splines 56 to the casing sleeve 34. The ratchet member 54 includes radially interior teeth 58 that interengage radially exterior ratchet teeth 60 on casing pup joint 62. The pup joint 62 a specialized section of tubing that has ratchet teeth 60 on its radial exterior. An exterior collar 64 secures a standard casing section 66 to the casing pup joint 62. As a result of the toothed engagement between the pup joint 62 and the ratchet member 54, the pup joint 62 may be moved upwardly with respect to the ratchet member 54 but not moved downwardly unless rotated. Casing sleeve 34 and casing string 66 serve as a riser from tubing head 14 to the subsea well.

It will be understood that the casing section 66 is normally the upper portion of a much longer casing string that is being run from the lower wellhead assembly 32 to a subsea well (not shown). The casing string associated with the casing section 66 is typically run downwardly, in association with a riser (not shown), from a floating platform such as the Spar. The riser and casing string are run downwardly to a subsea wellhead (not shown) where the riser and casing string are landed thus "tying back" the subsea wellhead to the floating platform.

The running and setting tool 10 includes a radially enlarged tool piston body 70 that is affixed at its upper end by threaded connection 72 to a section of drill pipe 74. The upper end of the drill pipe section 74 is shown secured by a collar 76 to a further section of drill pipe 78. Those of skill in the art will understand that the drill pipe section 78 may be part of a longer string of drill pipe members that is used for manipulation of the running and setting tool 10 and for disposing sections of casing string into a subsea wellbore.

The lower end of the tool piston body 70 is secured by threaded connection 80 to drill pipe member 82. The lower end of the drill pipe member 82 is secured by threaded connection 84 to a landing sub 86. The landing sub 86 is provided with a radially outer setting shoulder 88. A cap 90 is secured on the lower end of the landing sub 86. It is noted that a continuous fluid flowbore 92 is defined centrally through the drill pipe sections 78, 74, tool piston body 70, drill pipe member 82, landing sub 86 and cap 90. The tool piston body 70 and drill pipe member 82 may be considered, collectively, to form a central piston assembly that is radially disposed within the housing 14 and is axially moveable therewithin.

The running and setting tool 10 also includes some upper setting tool portions which are indicated generally by the reference numeral 94 in FIG. 1. The upper setting tool portions 94 include a radially enlarged sleeve 96 that presents an external profile 98 that is shaped to be complimentary to the landing profile 18 of the tubing head assembly housing 14. The upper setting tool portions 94 may, therefore, be releasably latched or affixed to the tubing hanger assembly 14 by lowering the upper setting tool portions 94 into the tubing head assembly housing 14 so that the two profiles 18, 98 become interlocked.

An annular fluid chamber 100 is defined between the sleeve 96 on its radial exterior and the drill pipe section 74 on the radial interior. The lower end of the chamber 100 is provided by the upper piston surface 102 of the tool piston body 70 while the upper end of the chamber 100 is provided by a cap 104 that is secured by threading to the sleeve 96. Various seals are used to make the chamber 100 fluid tight, as is known in the art.

The cap 104 is fitted with a fluid inlet 106 and a fluid outlet 108. Hydraulic lines 110, 112, shown schematically, are affixed to the each of these respective fittings. Hydraulic line 110 is used to transmit fluid to the fluid inlet 106 and into the chamber 100 from an external pressurized fluid source (not shown) while the hydraulic line 112 is used to receive used fluid exiting the chamber 100 through the fluid outlet 108 and transmit it to a fluid depository (not shown).

The running and setting tool is initially contained within the tubing head assembly 12, as FIG. 1 illustrates, and secured against axial movement therein by removable set screws 114 that are disposed through the tubing head assembly housing 14 and into engagement with the tool piston body 70. Because the set screws 114 engage the tool piston body 70 and the upper setting tool portions 94 are secured within the tubing head assembly 12, the running and setting tool 10 is initially interconnected with the tubing head assembly 12 in the manner shown in FIG. 1. Those of skill in the art will understand that, as a result of this interconnection, the tubing head assembly 12 may be lifted by lifting upwardly on the drill pipe section 78.

Figure 2:
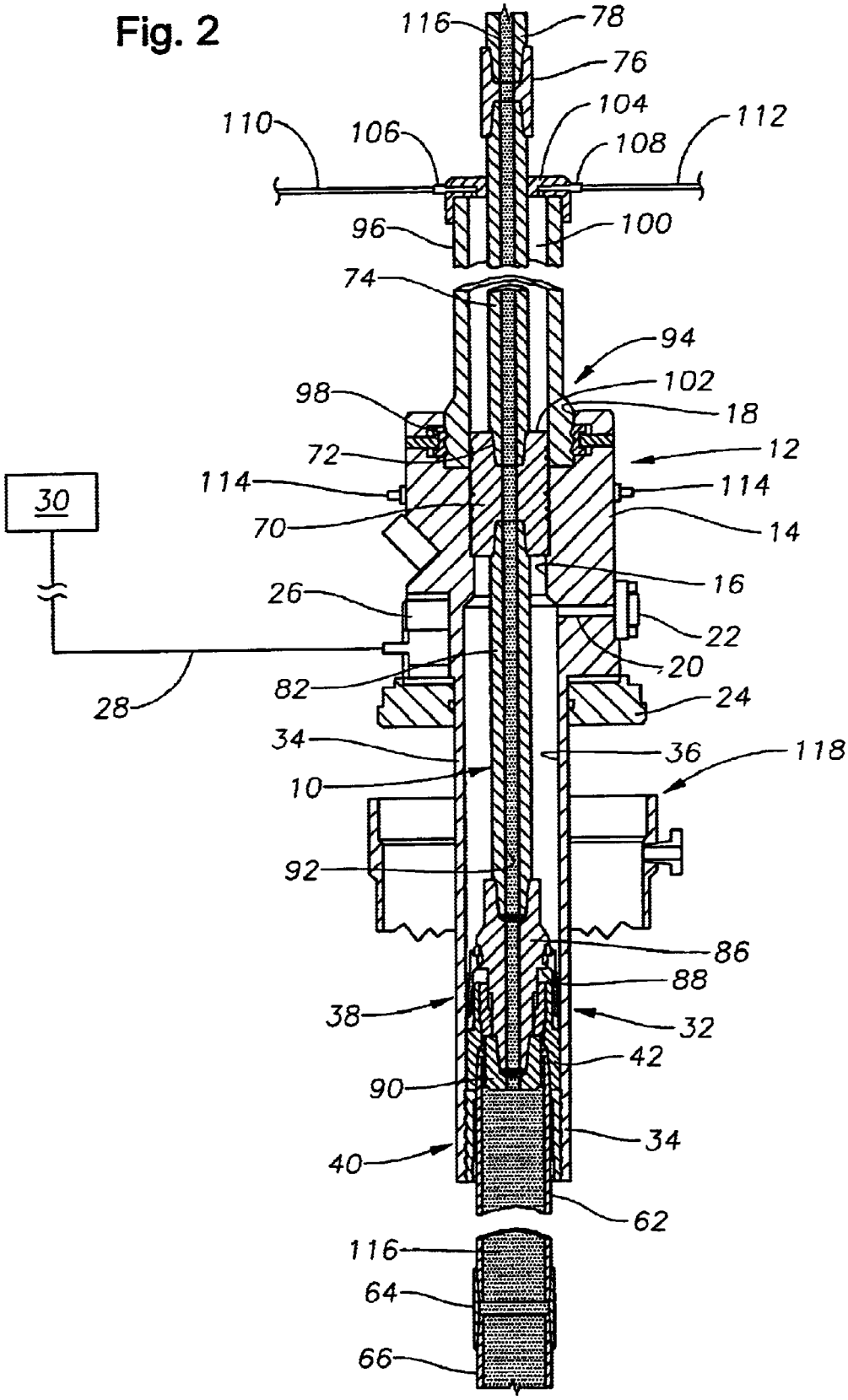
FIG. 2 is a side cross-sectional view of the tool and wellhead assembly shown in FIG. 1 wherein a pressure test is being conducted of the casing string.

FIG. 2 illustrates the running and setting tool assembly 10 and the tubing head assembly 12 after the casing string and riser have been run and landed at the subsea wellhead on the ocean floor. Pressurized fluid 116 is directed into the flowbore 92 from a point above the portion shown of drill string member 78. The fluid 116 fills the flowbore 92 as well as the string of casing members 66 below the tool 10. A pressure test is thereby conducted that allows operators to determine the presence and location of fluid leaks in the casing.

FIG. 2 also depicts a stem head assembly 118 which, those of skill in the art will understand, is an opening and seating area that is provided on the upper end of a floating structure or platform, such as a spar floating platform. The stem head assembly 118 is shaped and sized to receive therein the stem head adapter plate 24 in a latched seating which is shown in FIG. 3.

Figure 3:
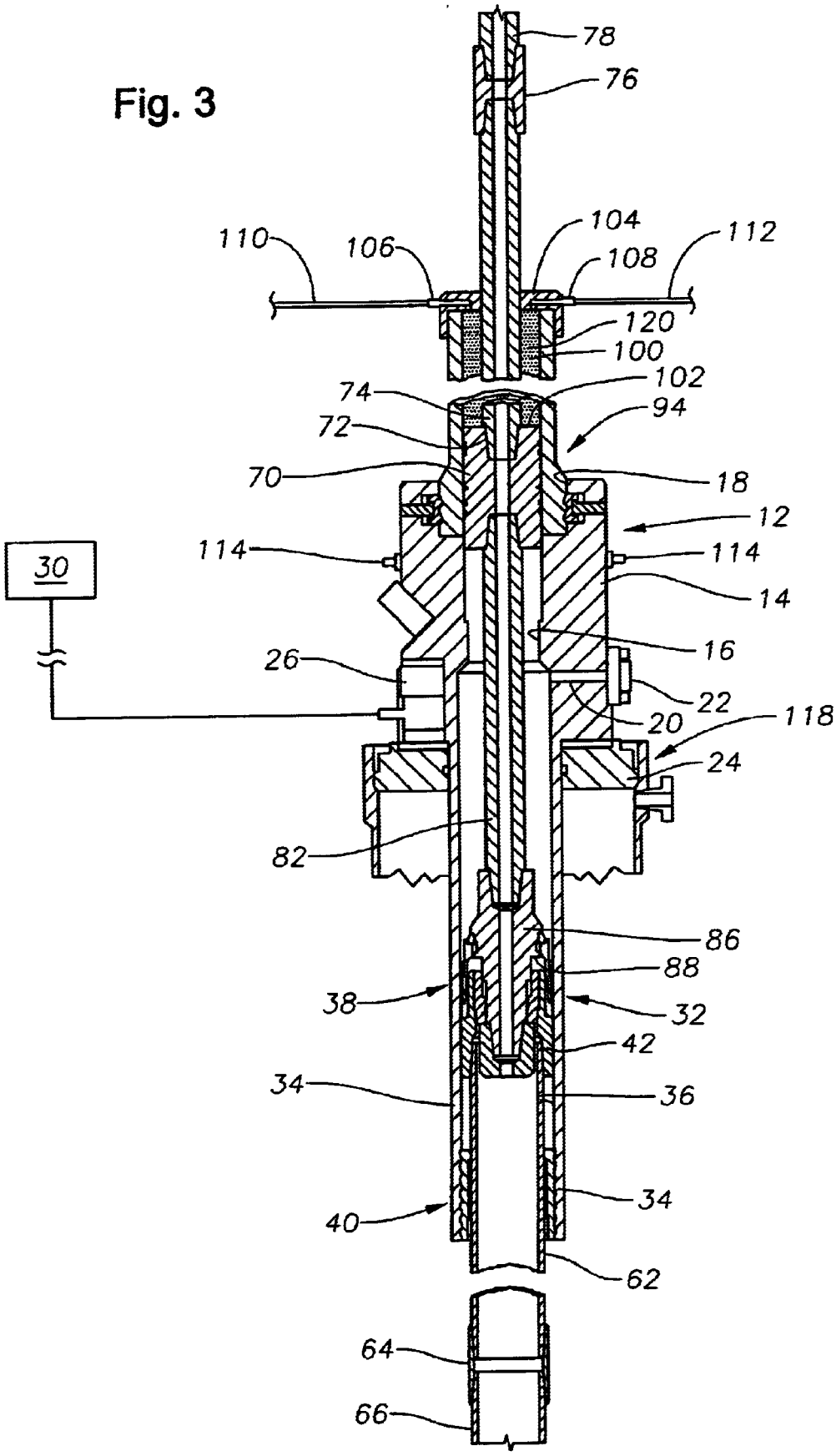
FIG. 3 is a side cross-sectional view of the tool and wellhead assembly shown in FIGS. 1 and 2 after having been landed in a stem head and with the setting tool being energized.
Figure 4:
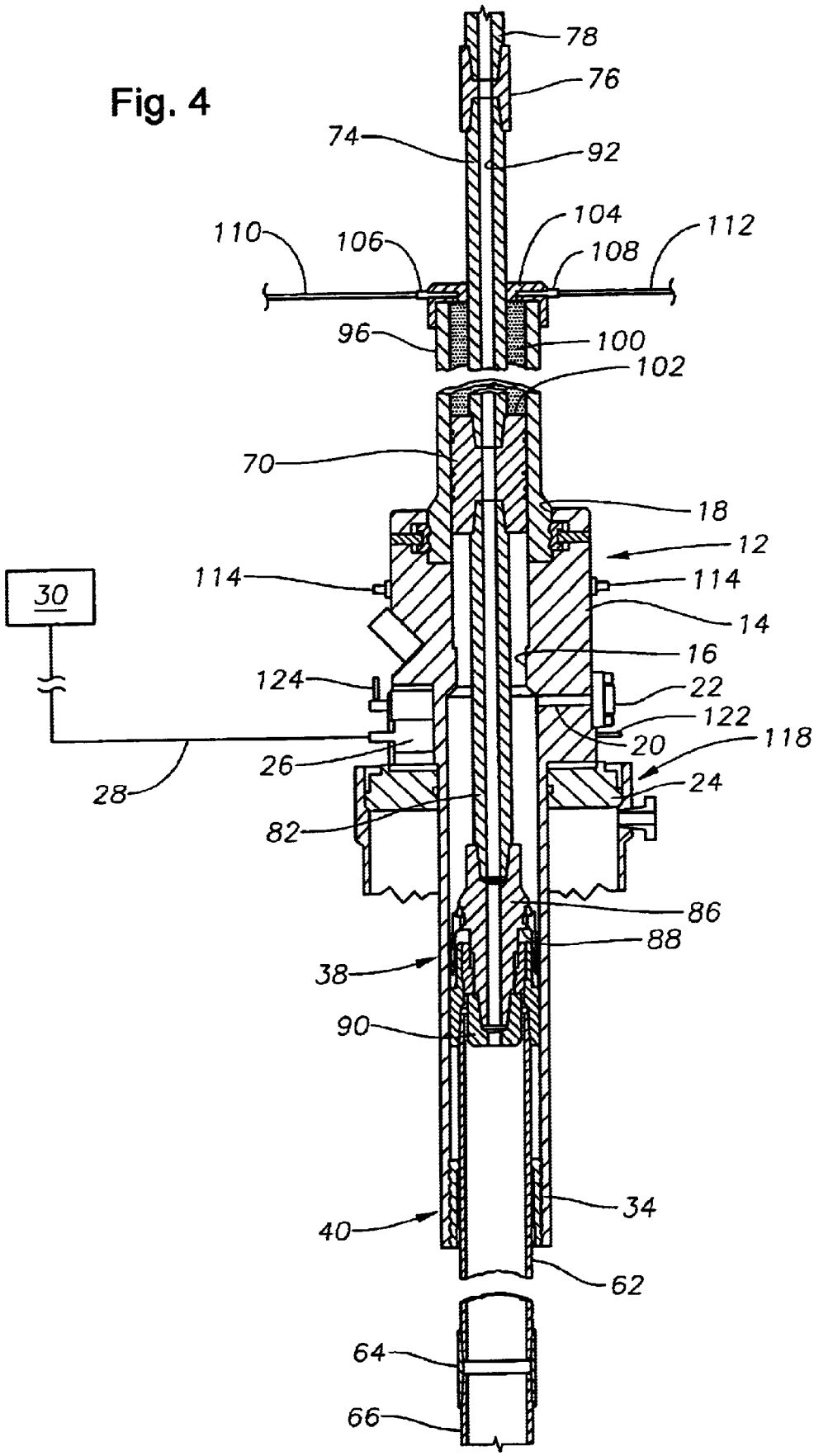
FIG. 4 is a side cross-sectional view of the tool assembly shown in FIGS. 1–3 wherein the tool assembly 10 is being locked down to the stem head.

FIGS. 2 and 3 depict the operation of landing the running and setting tool assembly 10 upon the stem head assembly 118. In FIG. 2, the lower wellhead assembly 32 is disposed within the stem head assembly 118. However, the stem head adapter plate 24 is not yet seated upon the stem head 118. Fluid 120 is then pumped into chamber 100 through the hydraulic line 110 and fluid inlet 106. The set screws 114 are then loosened so that the tool piston body 70 of the running and setting tool 10 can move axially with respect to the tubing head assembly housing 14. Consequently, the tubing head assembly 12 is freed to move axially downward with respect to the running and setting tool 10 until the stem head adapter plate 24 is seated upon the stem head assembly 118. As the tubing head assembly 12 descends, the fluid 120 is expelled from the chamber 100 through the fluid outlet 108 and hydraulic line 112. The operation of expelling the fluid 120 slows the downward movement of the tubing head assembly 12 and, thereby, assures that the tubing head assembly 12 is landed onto the stem head 118 in a controlled manner. The tubing head assembly 12 is then secured to the stem head assembly 118, as depicted in FIG. 4, using split rings 122 and retainer bolts 124. The details of such securing operations are known in the art and, therefore, will not be detailed here.

Figure 5:
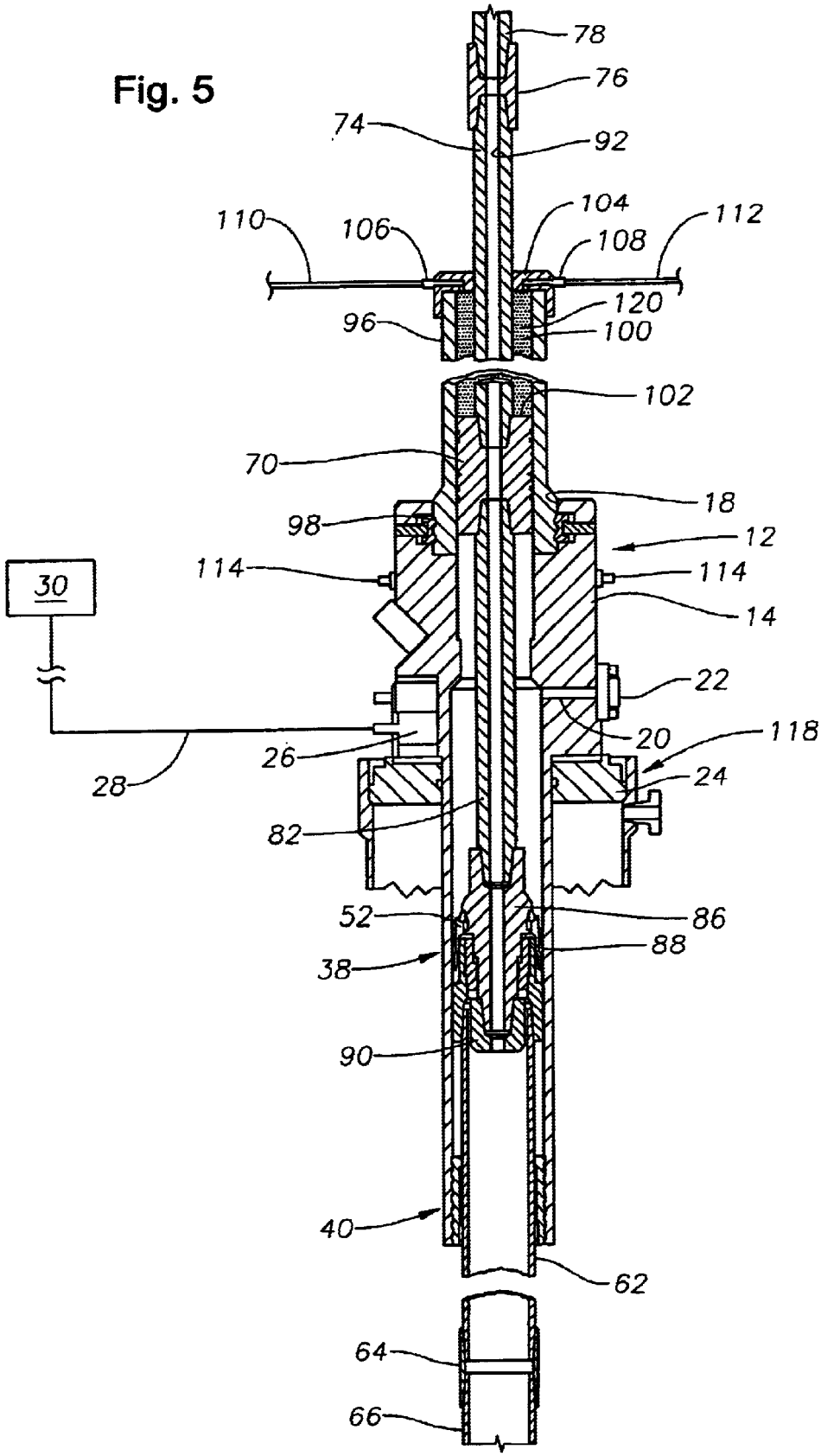
FIG. 5 is a side cross-sectional view of the tool and wellhead assembly shown in FIGS. 1–4 after the tool assembly 10 has been operated to set the riser seal.

Once the tubing head assembly 12 has been secured to the stem head assembly 118, the running and setting tool 10 is then tensioned to test the riser. At this point, the seal assembly 38 is then energized or set. FIG. 5 illustrates the seal assembly 38 being set or energized. Fluid 120 is again pumped into chamber 100 and exerts fluid pressure upon piston surface 102 of the piston body 70. Because the tubing head assembly is secured to the stem head 118, the fluid pressure moves the piston body 70 downwardly within the tubing head housing 14. The setting shoulder 88 of the landing sub 86 urges the setting sleeve 52 downwardly, thereby setting the seal assembly 38.

Figure 6:
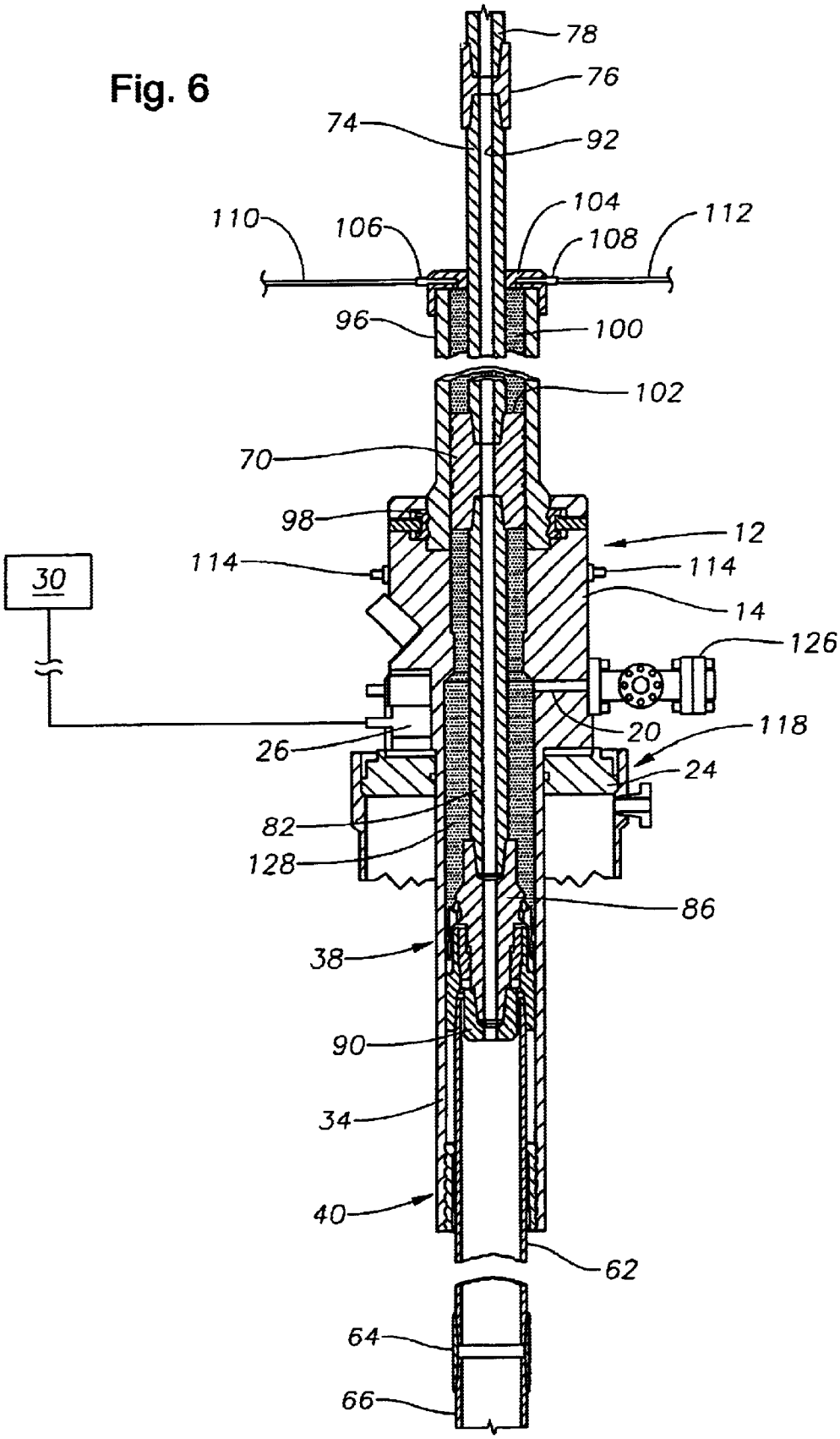
FIG. 6 is a side cross-sectional view of the tool and wellhead assembly shown in FIGS. 1–5 illustrating pressure testing of the riser seal.

A subsequent pressure test of the seal assembly 38 may then be conducted. The test is illustrated in FIG. 6 which shows that cover 22 has been removed from the lateral fluid test port 20 in the tubing head housing 14. A test pressure port 126 is affixed to the test port 20. Fluid 128 is then pumped through the test port 20 and into the annular space between the tubing head housing 14 and the drill pipe member 82. Fluid pressure may be increased in accordance with a user's requirement or to a pressure at which it is desired to ensure that the seal assembly 38 will contain fluid.

Figure 7:
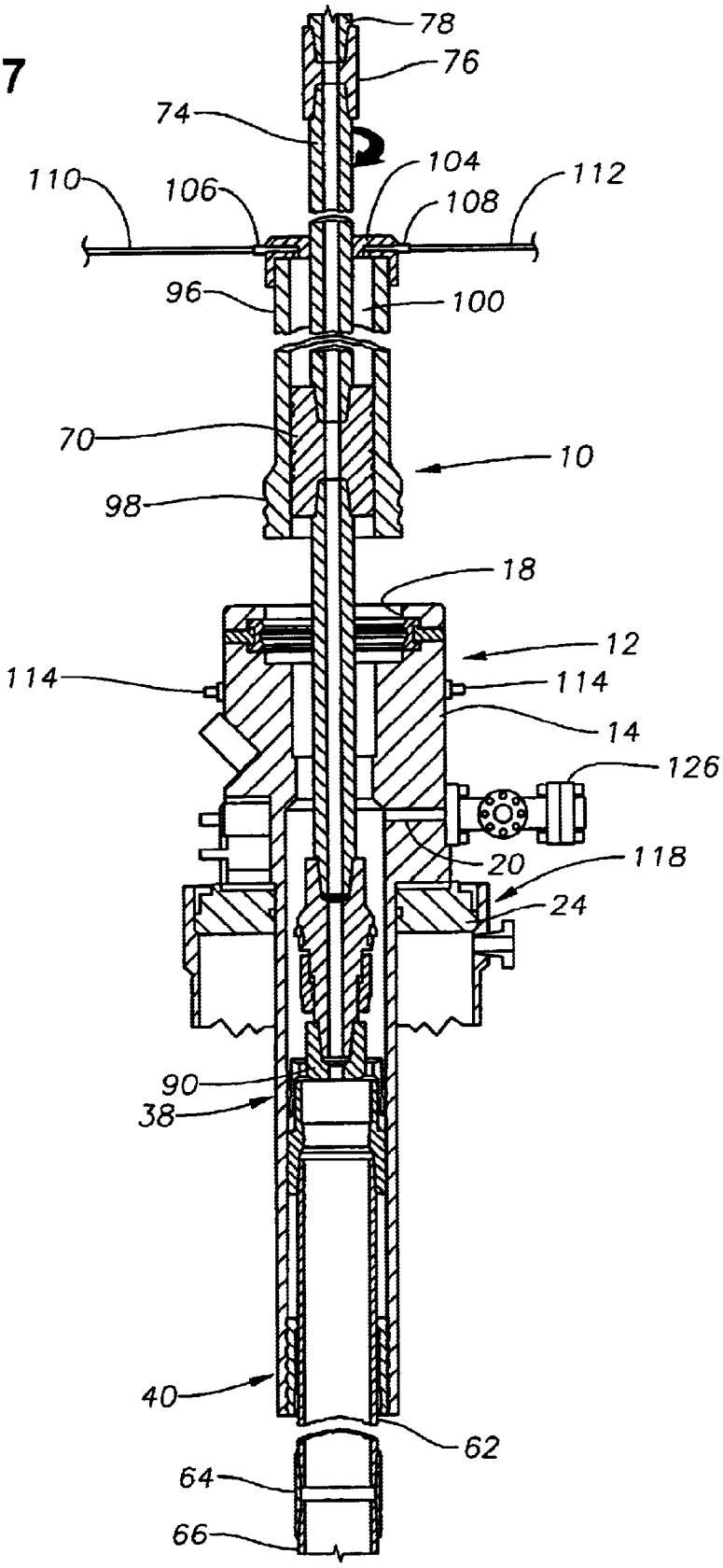
FIG. 7 illustrates the removal of the wellhead setting and running tool from the wellhead assembly.

Once pressure testing of the seal assembly 38 has been conducted, the running and setting tool 10 is removed from the tubing head assembly 12 by detachably separating the external profile 98 of the radially enlarged sleeve 96 from the interior profile 18 of the tubing head housing 14. In the exemplary embodiment depicted in FIG. 7, the upper drill string portions 78, 74 are rotated in a clockwise manner to unthread the profile 98 from the profile 18. The running and setting tool 10 may then be completely removed from the tubing head 12 by pulling upwardly on the drill string section 78.

Figure 8:
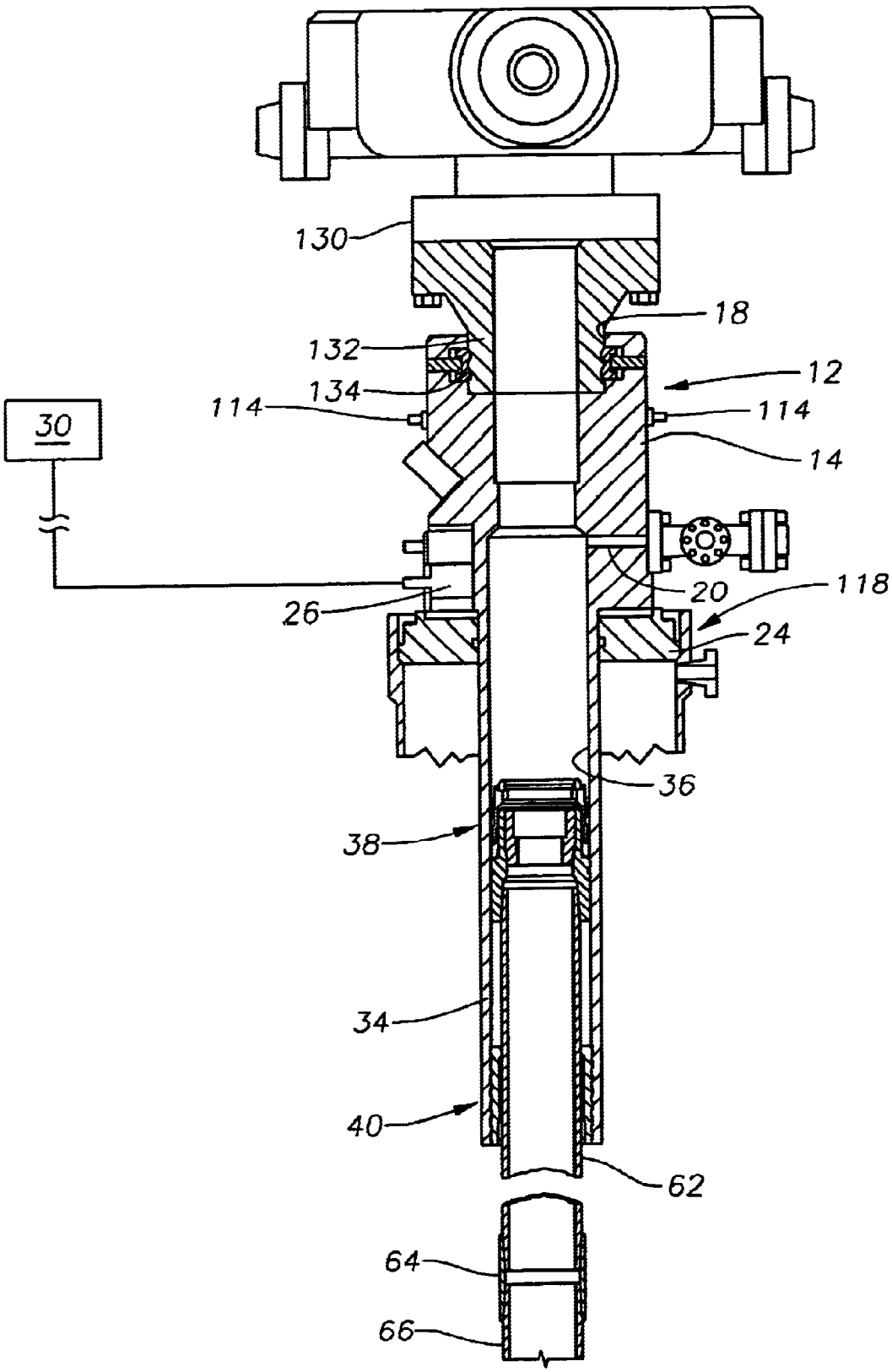
FIG. 8 depicts the wellhead assembly after having a BOP stack installed atop it.

After the running and setting tool 10 has been removed from the tubing head housing 14, a blowout preventer (or BOP) 130 is installed atop the tubing head housing 14. FIG. 8 illustrates such an installation. The structure and operation of BOP's is well known and understood in the art and, therefore, will not be described here. The BOP 130 includes a downwardly directed narrowed neck 132 having an exterior profile 134 that is shaped and sized to be complimentary to the interior profile 18 of the tubing head housing 14. The BOP 130 is secured to the tubing head assembly 12 by latching the neck 132 into the profile 18.

Figure 9:
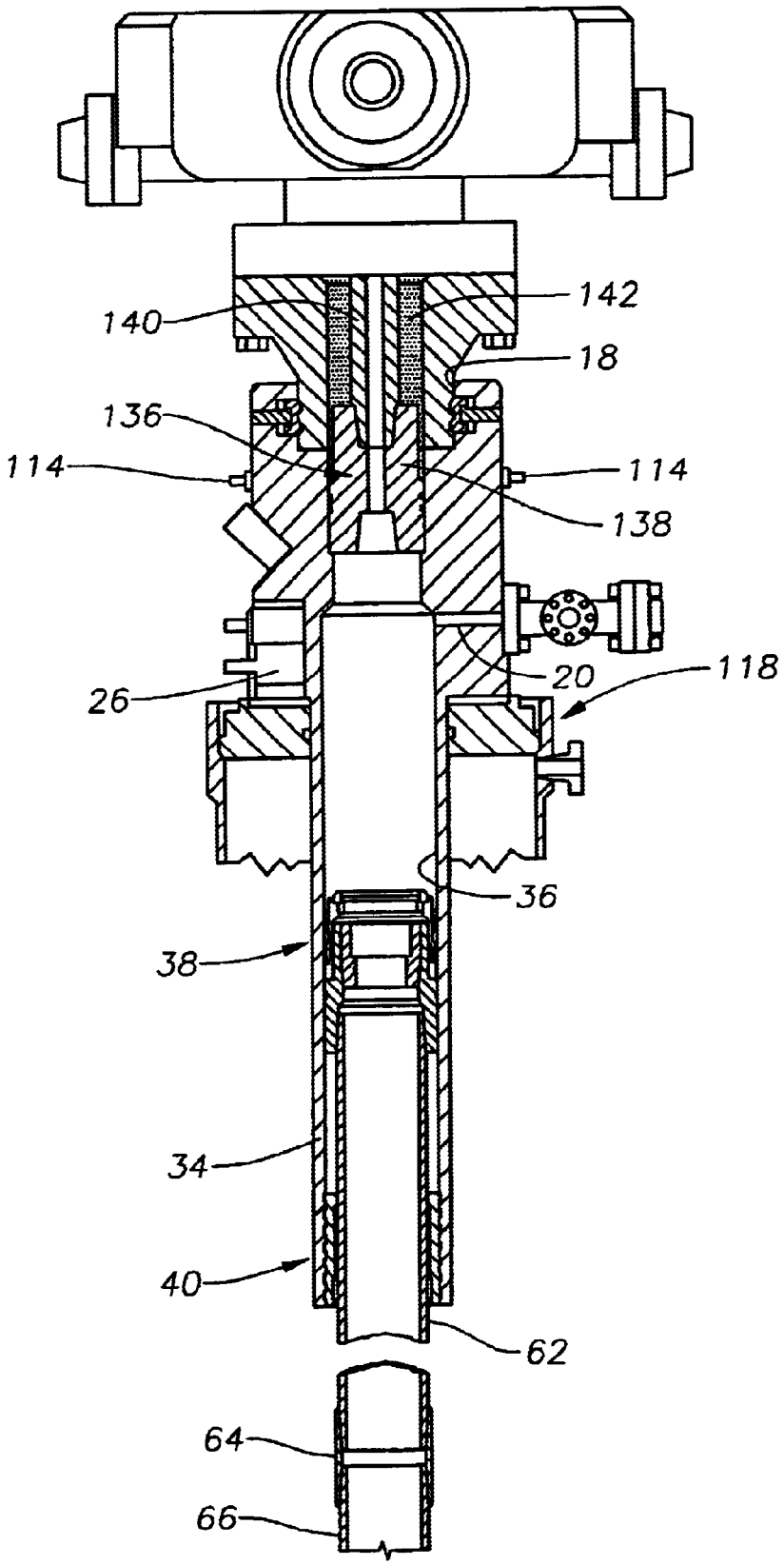
FIG. 9 illustrates testing of the BOP connection using a combination test plug and running tool.

FIG. 9 illustrates conduct of a subsequent pressure test. A combination test plug/running and retrieving tool 136 is disposed downward through the BOP and into the flowbore 36 of the installed tubing head assembly 12. The test plug/running and receiving tool 136 includes an enlarged piston head 138 that is threadedly secured to a section of drill pipe 140. Pressurized fluid 142 is then inserted into the flowbore 36 above the piston head 138.

The invention may be considered to provide a wellhead assembly system that is useful for both installing tubing head components onto a floating platform as well as conducting operations required for "tying back" a subsea wellhead to the sea-borne tubing head. These latter operations include tension and pressure testing integrity checks for the riser or casing string. This wellhead assembly system may be considered to be made up, generally, of the running and setting tool 10, the tubing head assembly 12 along with the affixed casing sleeve 34.

While the invention has been shown in only some of its forms, it should be apparent to those skilled in the art that it is not so limited, but is susceptible to various changes without departing from the scope of the invention.

What is claimed is:

1. A wellhead assembly system comprising:

a) a tubing head adapted to be landed upon a floating structure, the tubing head comprising a housing having a generally vertically-disposed bore therethrough and a landing profile for selectively engaging a floating structure;

b) a running and setting tool comprising:

a central piston assembly radially disposed within the bore of the tubing head and being axially moveable therewithin, a landing sub affixed to a lower end of the central piston assembly and being selectively securable to a riser section member of a riser string extending to a subsea wellhead;

a fluid bore disposed through the central piston assembly and landing sub; and a matching profile upon the central piston assembly for reversably interconnecting the central piston assembly with the tubing head housing.

2. The wellhead assembly system of claim 1 further comprising a tubular riser sleeve secured to a lower end of the tubing head and sized to retain an upper portion of the riser string member radially within, and a securing assembly for securing an upper end of the riser string member radially within the riser sleeve.

3. The wellhead assembly system of claim 2 wherein the securing assembly further comprises a ratchet suspension assembly having a plurality of radially interior teeth to interengage a radial exterior of a riser string member.

4. The wellhead assembly system of claim 1 further comprising a fluid chamber formed between the tubing head and the central piston assembly that can be selectively filled to move the piston assembly axially with respect to the tubing head.

5. The wellhead assembly system of claim 1 wherein the tubing head further includes a load cell for measuring tension upon the riser string.

6. The wellhead assembly system of claim 1 further comprising means for selectively securing the central piston assembly within the tubing head to preclude axial movement between the central piston assembly and the tubing head.

7. The wellhead assembly system of claim 6 wherein the means for selectively securing comprises a set screw.

8. A running and setting tool for landing portions of a wellhead upon a floating structure, the tool comprising:

a central piston assembly adapted to be radially disposed within a bore of a tubing head to be axially moveable therewithin, a landing sub affixed to a lower end of the central piston assembly and being selectively securable to a riser section member of a riser string;

a fluid bore disposed through the central piston assembly and landing sub; and a profile upon the central piston assembly for reversably interconnecting the central piston assembly with the tubing head.

9. The running and setting tool of claim 8 wherein the landing sub further comprises a seal assembly for selectively creating a fluid seal within a surrounding riser sleeve depending from the tubing head.

10. The running and setting tool of claim 8 further comprising means for selectively securing the central piston assembly within the tubing head to preclude axial movement between the central piston assembly and the tubing head.

11. The running and setting tool of claim 10 wherein the means for selectively securing comprises a set screw.

12. A method of assembling a tubing head onto a floating structure, comprising the steps of:

reversibly securing an upper portion of a central piston assembly to a tubing head;

reversibly affixing a landing sub on a lower portion of the central piston assembly to a riser section member of a riser string;

pressure testing the riser string;

landing the tubing head onto the floating structure; and energizing a riser seal between the landing sub and a surrounding sleeve that depends from the tubing head.

13. The method of claim 12 further comprising the step of pressure testing the riser seal.

14. The method of claim 12 wherein the step of energizing the riser seal comprises axially moving the central piston assembly with respect to the tubing head.

15. The method of claim 14 wherein the step of axially moving the central piston assembly with respect to the tubing head further comprises the step of pressurizing a fluid chamber.

16. The method of claim 12 further comprising the step of tensioning the riser string.

17. The method of claim 16 further comprising the step of measuring the tension load upon the riser string via a load cell mounted to the tubing head.

18. The method of claim 12 further comprising the step of landing a blowout preventer atop the tubing head.

19. A method of connecting a riser string between a subsea wellhead and a floating structure, comprising:

(a) lowering a riser string through an opening in the floating structure;

(b) connecting a running tool to a tubing head that has a depending a riser sleeve, lowering the riser sleeve over an upper portion of the riser string and connecting a lower end of the running tool to an upper end of the riser string;

(c) connecting a lower end of the riser string to the subsea wellhead;

(d) while supporting the riser string with the running tool, lowering the tubing hanger and riser sleeve relative to the running tool and landing the tubing head on the floating structure; then (e) with the running tool, setting a seal between the riser sleeve and an upper portion of the riser string; then (f) disengaging the running tool from the riser string and removing the running tool from the tubing head.

20. The method according to claim 19, wherein step (d) comprises providing the running tool with a piston and a fluid chamber located above the piston, then expelling liquid from the fluid chamber in a controlled manner as the tubing head descends.

21. The method according to claim 19, wherein step (d) comprises:

providing the running tool with a seal setting member on its lower end;

providing the running tool with a piston and a fluid chamber located above the piston, then applying fluid pressure to the fluid chamber to cause the piston to move downward in the fluid chamber, the downward movement of the piston causing downward movement of the seal setting member to energize the seal.

22. The method according to claim 21, further comprising testing the seal after setting by applying fluid pressure between the seal and a lower side of the piston.

* * * * *